US011666104B2

(12) United States Patent
Flores

(10) Patent No.: US 11,666,104 B2
(45) Date of Patent: Jun. 6, 2023

(54) BRASSIERE WITH DUAL-USE BRA STRAPS

(71) Applicant: Carla Flores, Watsonville, CA (US)

(72) Inventor: Carla Flores, Watsonville, CA (US)

( * ) Notice: Subject to any disclaimer, the term of this patent is extended or adjusted under 35 U.S.C. 154(b) by 85 days.

(21) Appl. No.: 17/518,745

(22) Filed: Nov. 4, 2021

(65) Prior Publication Data

US 2023/0135933 A1 May 4, 2023

(51) Int. Cl.
*A41C 3/12* (2006.01)
*A41C 3/00* (2006.01)

(52) U.S. Cl.
CPC ..... *A41C 3/12* (2013.01); *A41C 3/0028* (2013.01)

(58) Field of Classification Search
CPC ..... A41C 3/0028; A41C 3/12
USPC ..... 450/86
See application file for complete search history.

(56) References Cited

U.S. PATENT DOCUMENTS 5,964,642 A * 10/1999 Fildan ..... A41F 1/006 450/86
6,381,752 B1 * 5/2002 Cartelli ..... A41C 3/00 2/88
7,278,900 B1 * 10/2007 Ostaseski ..... A41F 15/02 24/301
7,314,400 B2 * 1/2008 Fildan ..... A41F 15/002 450/86
7,410,407 B2 * 8/2008 Krammel ..... A41F 15/02 450/86
8,827,766 B2 * 9/2014 Lin ..... A44B 11/2596 450/86
9,961,944 B2 * 5/2018 Fayad ..... A41C 3/0028
10,342,269 B1 * 7/2019 Rutkoski ..... A41C 3/0057
10,765,153 B2 * 9/2020 Rendone ..... A41C 3/00
11,350,680 B2 * 6/2022 Rutkoski ..... A41C 3/0028
2009/0126163 A1 * 5/2009 Groner ..... A41F 15/02 450/86
2009/0215360 A1 * 8/2009 Brideson ..... A44B 11/04 450/86
2010/0015888 A1 * 1/2010 Groner ..... A41C 3/0028 450/86
2013/0029561 A1 * 1/2013 Lin ..... A44B 11/2596 450/86
2015/0140898 A1 * 5/2015 Gebron ..... A41C 3/12 450/86
2017/0295877 A1 * 10/2017 Campbell ..... A41F 15/002

* cited by examiner

*Primary Examiner* — Gloria M Hale
(74) *Attorney, Agent, or Firm* — Donald R. Boys; Central Coast Patent Agency LLC

(57) ABSTRACT

An aftermarket bra strap ensemble has two adjustable straps, each having an unattached end, and a strap buckle on the other end, and two double straps, one passing through a loop of the strap buckle on the end of each of the two adjustable straps. The double straps also pass through an anchor loop at ends away from the strap buckles of the adjustable straps, and opposite ends of the double straps attach to separate anchor rings, one of which is adapted to hook to the other.

5 Claims, 7 Drawing Sheets

Section A-A

Section A - A

BRASSIERE WITH DUAL-USE BRA STRAPS

BACKGROUND OF THE INVENTION

1. Field of the Invention

The present invention is in the technical area of lingerie and pertains more particularly to brassieres and adjustable straps for brassieres.

2. Description of Related Art

Brassieres and bra straps are quite well-known in the art. Brassieres in the conventional art typically comprise a pair of cups for holding the breasts. The cups are usually joined centrally in the front and have extensions on each side that wrap around the sides of a woman's upper torso, with one or more hooks or clasps on the ends of the extensions, such that the extensions may be joined by the hooks or clasps at the back, enclosing the torso with the cups holding the breasts.

To hold the brassiere up a pair of straps are usually provided with one strap joined to the brassiere by a first slipping clip in the upper front over one cup, with the one strap passing over the wearer's shoulder and extending down to attach in the back to the extension on the same side at some dimension from the hooks or clasps that join the extensions in the middle of the back. A second strap attaches to the brassiere by a second slipping clip over the other cup and passes over the wearer's other shoulder to fasten to the extension in the back in a mirror image of the fastening of the first strap in the back.

The bra straps each conventionally have an adjustment buckle in the front by which the overall length of the strap may be shortened or lengthened to pride support to the cups in the front.

One problem known to the conventional art is that with one strap passing over each shoulder to fasten to the brassiere extension in the back, the straps may ride out on the shoulders to be exposed, depending to some extent on the nature of an upper garment worn over the brassiere. There have been attempts in the art to correct this problem, by, for example, providing an intermediary horizontal strap that may hook to each of the bra over-the-shoulder straps, to hold them from sliding outward on the wearer's shoulder. In these arrangements the vertical support of the straps may be compromised.

What is clearly needed is a bra strap system that provides both adjustable vertical support and selectable connection between the straps to control side slip of the straps on the wearer's shoulders.

BRIEF SUMMARY OF THE INVENTION

In one embodiment of the invention a brassiere is provided, comprising a first cup and a second cup attached at center to carry breasts of a wearer of the brassiere, a first torso web extending from the first cup opposite the center attachment, adapted to form around the wearer's torso, having a first joining mechanism at an end away from the first cup, a second torso web extending from the second cup opposite the center attachment, adapted to form around the wearer's torso, having a second joining mechanism at an end away from the second cup, such that the first and second torso webs, joined by the joining mechanisms, secure the brassiere around the wearer's torso, a first adjustable strap attached at an upper extremity of the first cup, having a first adjusting buckle in front and having a first strap buckle at an end away from the attachment to the first cup, the first strap buckle adapted to present over the wearer's first shoulder, a second adjustable strap attached at an upper extremity of the second cup, having a second adjusting buckle in front and having a second strap buckle at an end away from the attachment to the second cup, the second strap buckle adapted to present over the wearer's second shoulder, a first single strap having a first and a second end, the first single strap passing through a loop of the first strap buckle and through a loop of a first slip anchor fastened to an upper edge of the first torso web, forming an outer substantially vertical first elastic connection between the first strap buckle and the first slip anchor, the first and second ends of the first single strap fastened to a single first anchor loop at a midpoint between the first strap buckle and the first slip anchor, forming an inner, substantially vertical second elastic connection behind the first substantially vertical elastic connection, and a second single strap having a first and a second end, the second single strap passing through a loop of the second strap buckle and through a loop of a second slip anchor fastened to an upper edge of the second torso web, forming an outer substantially vertical third elastic connection between the second strap buckle and the second slip anchor, the first and second ends of the second single strap fastened to a single second anchor loop at a midpoint between the second strap buckle and the second slip anchor, forming an inner, substantially vertical fourth elastic connection behind the third substantially vertical elastic connection.

In one embodiment the brassiere further comprises the first and second anchor loops moved to be adjacent and joined at a midpoint horizontally between the between the first and the third substantially vertical elastic connections, such that a horizontal force component is applied toward center to both the two strap buckles and the two slip anchors, while the first and third elastic connections continue to provide substantially vertical force components between the strap buckles and the slip anchors.

In one embodiment the first anchor loop has a hook element securely joined, the hook element having a curved end adapted to hook over a portion of the second anchor loop.

In one embodiment an aftermarket bra strap ensemble is provided, comprising a first adjustable strap having an unattached single end and a first adjusting buckle, with the first adjustable strap passing through a loop of a first strap buckle at an end away from the unattached single end, a second adjustable strap having an unattached single end and a second adjusting buckle, with the second adjustable strap passing through a loop of a second strap buckle at an end away from the unattached single end, a first single strap having a first and a second end, the first single strap passing through a loop of the first strap buckle and through a loop of a first slip anchor, forming a first elastic connection between the first strap buckle and the third slip anchor, the first and second ends of the first single strap fastened to a single first anchor loop at a midpoint between the first strap buckle and the first slip anchor, forming an inner, substantially vertical second elastic connection behind the first substantially vertical elastic connection, and a second single strap having a first and a second end, the second single strap passing through a loop of the second strap buckle and through a loop of a second slip anchor, forming a second elastic connection between the second strap buckle and the second slip anchor, the first and second ends of the first single strap fastened to a single first anchor loop at a midpoint between the first strap buckle and the first slip anchor, forming an inner, substantially vertical second elastic connection behind the first substantially vertical elastic connection.

And in one embodiment the first anchor loop has a hook element securely joined, the hook element having a curved end adapted to hook over a portion of the second anchor loop.

DETAILED DESCRIPTION OF THE INVENTION

Figure 1:
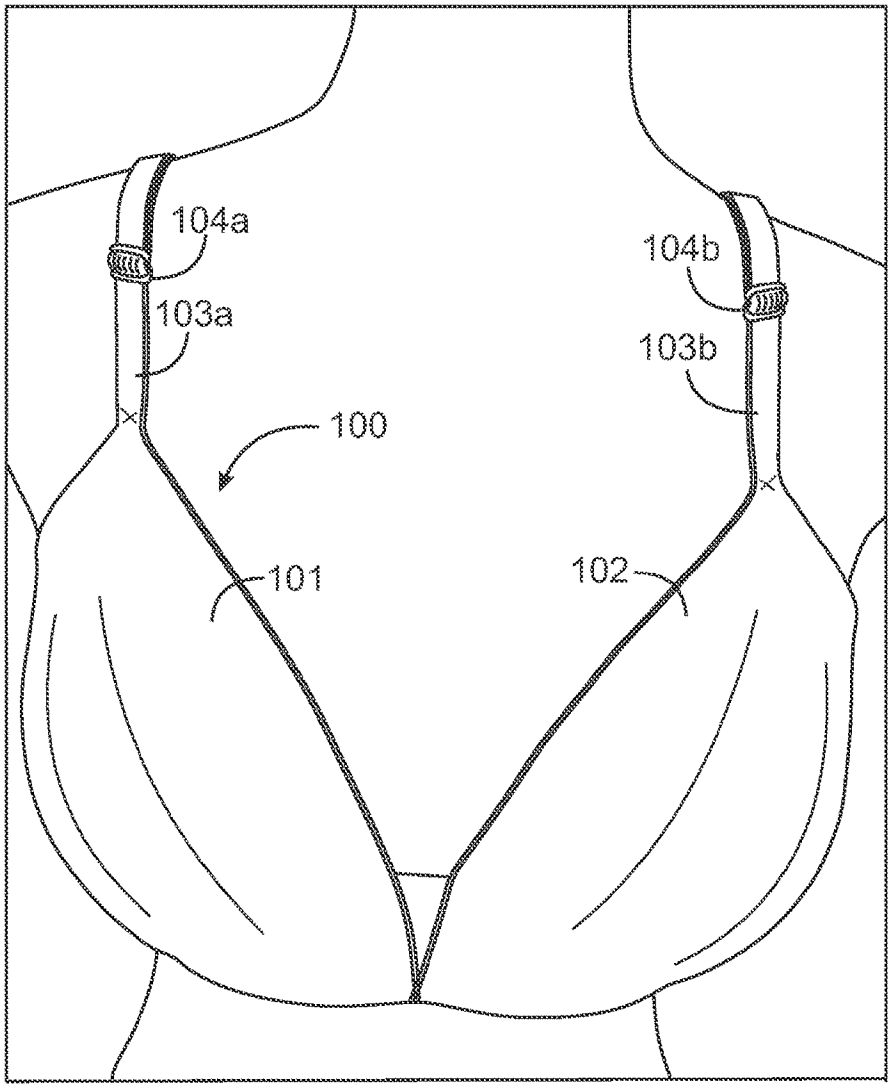
FIG. 1 is a front view of a brassiere and strap arrangement in an embodiment of the invention.

FIG. 1 is a front view of a brassiere and strap arrangement in an embodiment of the invention. In FIG. 1 a brassiere 100 comprises two cups 101 and 102, joined in front, adapted for carrying the breasts of a person wearing the brassiere. Cup 101 has an adjustable strap 103*a* sewn in this example at an upper extremity of the cup. Strap 103*a* comprises a single length of elastic strap fabric that is anchored at one end of the single length to a median bar of a strap buckle 104*a*, proceeds upward and over the wearer's shoulder, to another strap buckle behind the wearer's shoulder (not seen in FIG. 1 but illustrated in FIG. 3), around an upper bar of that strap buckle behind, back to strap buckle 104*a* in front, under an upper bar of the strap buckle in front and under a lower bar of the strap buckle in front, than down to the point where it is sewn to the upper extremity of cup 101, as shown.

This arrangement of the single length of elastic strap material enables the person wearing the brassiere to move strap buckle 104*a* up to loosen the connection or down to tighten the connection, by lengthening or shortening the overall length of the folded strap, which adds or detracts from upward force on cup 101.

It may be seen in FIG. 1 that a second adjustable strap 103*b*, the same as adjustable strap 103*a*, is sewn in this example to an upper extremity of cup 102 of brassiere 100 and is also adjustable to control upward force on cup 102.

Figure 2B:
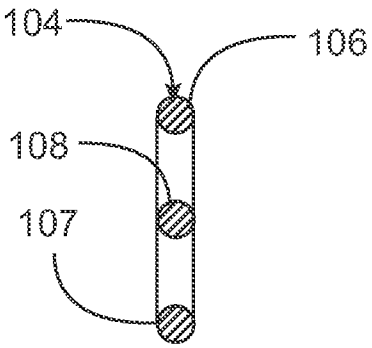
FIG. 2B is a cross section of the strap buckle of FIG. 2A in an embodiment of the invention.
Figure 2A:
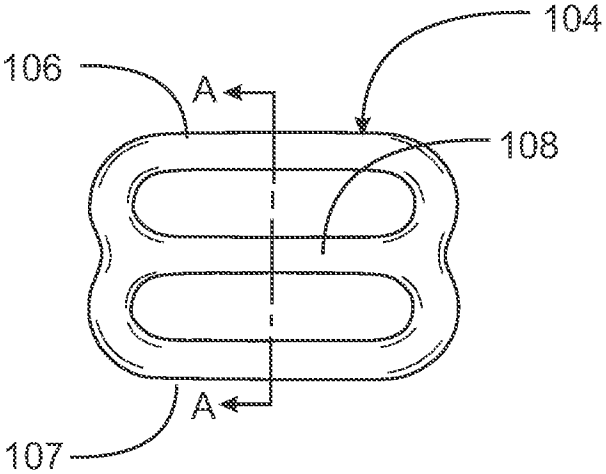
FIG. 2A is a plan view of a strap buckle in an embodiment of the invention.

FIG. 2A is a plan view of a strap buckle 104 in an embodiment of the invention. Strap buckle 104 has an upper bar 106, a lower bar 107 and a median bar 108. FIG. 2B is a cross-section of strap buckle 104 taken along section line A-A of FIG. 2A. Strap buckles of this sort are used at several places in the bra strap arrangement according to embodiments of the invention.

Figure 3:
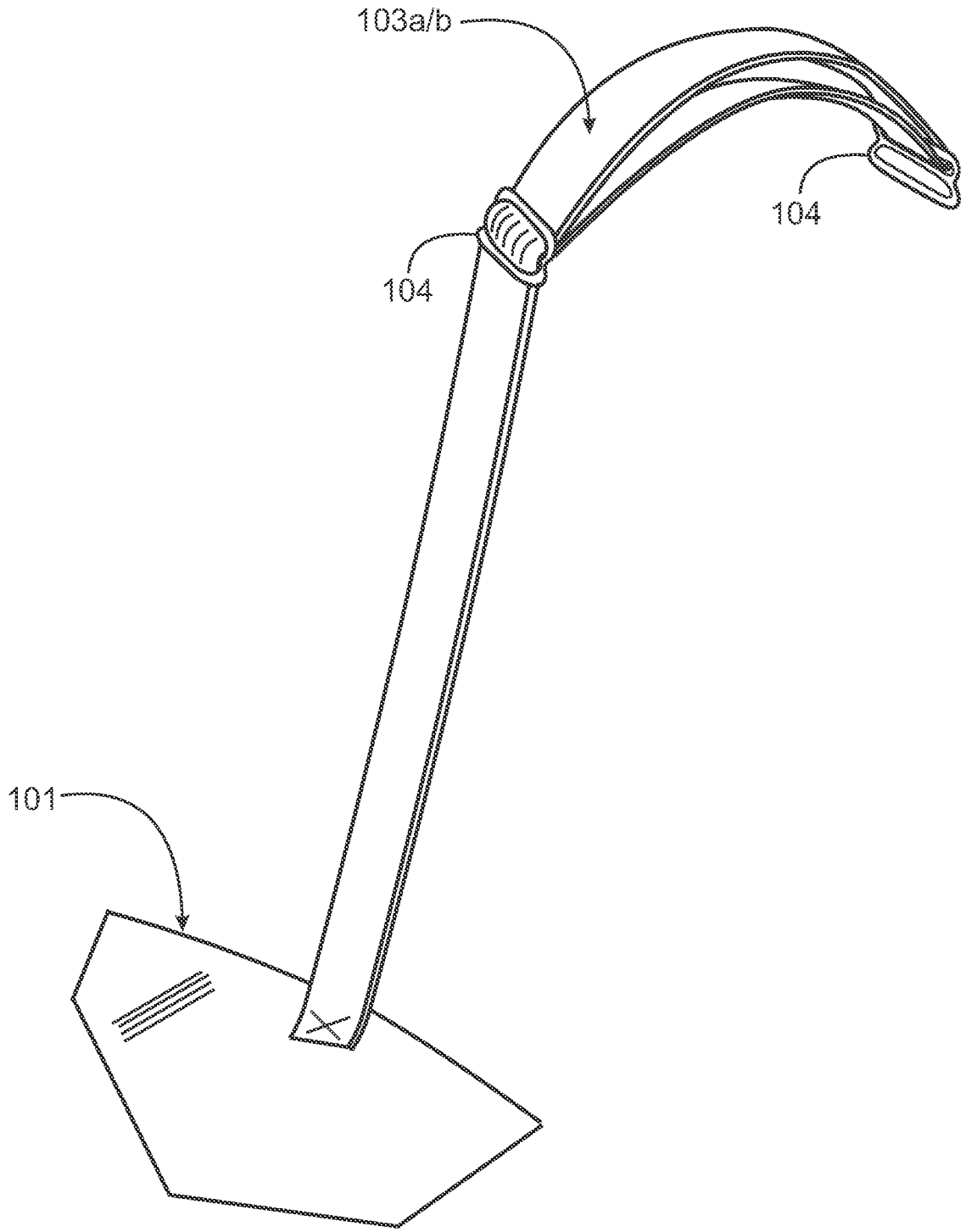
FIG. 3 is a perspective view of one front strap in an embodiment of the invention.

FIG. 3 is a perspective view of one front strap 103*a/b* in an embodiment of the invention, sewn in this example to a cup of brassiere 101, such that the arrangement and connection to a strap buckle behind the wearer's shoulder may be seen in better detail than is visible in FIG. 1. The operation in adjustment is described above with reference to FIG. 1. Strap buckles 104 over the wearer's shoulder provide a connection point for unique back straps in an embodiment of the invention, which back straps are described in enabling detail below.

Figure 4:
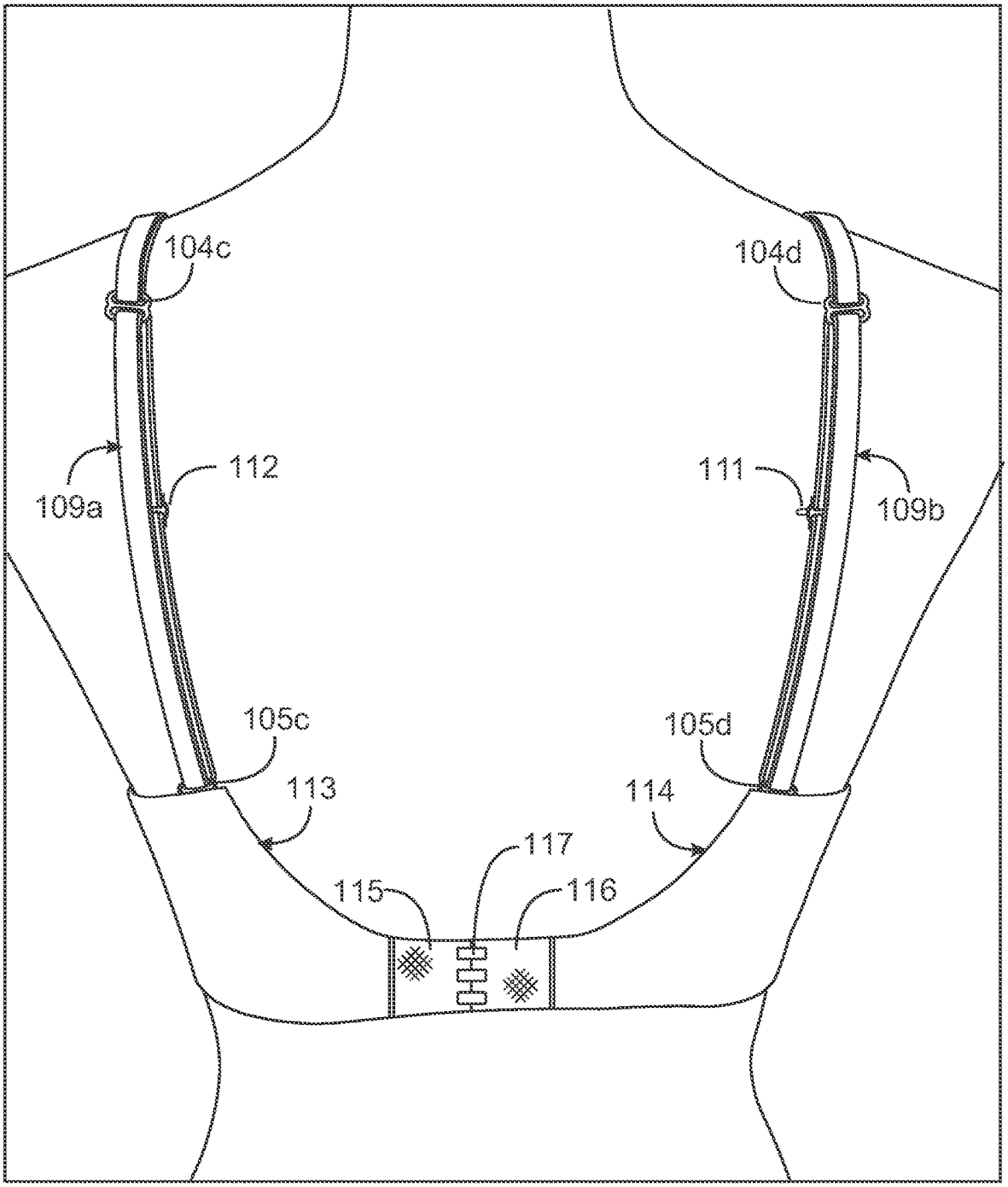
FIG. 4 is a back elevation view of a brassiere and strap arrangement in an embodiment of the invention.

FIG. 4 is a back view of a brassiere and strap arrangement in an embodiment of the invention. Cups 101 and 102 of brassiere 100 are joined each to a torso web that is adapted to pass around the wearer's torso and to fasten together at the wearer's back. Torso web 113 extends from cup 102 in the front and torso web 114 extends from cup 101 in the front. Each torso web in this example has a region of elastic material at an end away from the cup, region 115 for web 113 and region 116 for web 114. One of regions 115 and 116 has a number of hooks and the other has the same number of hook anchors, such that the end of regions 115 and 116 may be stretched and joined, closing the torso webs around the torso of the wearer and securing the brassiere on the wearer's body.

The person of skill in the art will recognize that the webs as described above and the joining of the webs behind is a common way to join and fasten a brassiere in the art, and that there are a variety of different ways that this function may be accomplished.

Referring again to FIG. 4 shoulder straps 103*a* and 103*b* proceeding from attachment to the cups as seen in FIG. 1 and as also as seen in FIG. 3 are shown over the wearer's shoulders at the back, ending in strap buckles 104*c* and 104*d*. A pair of unique straps 109*a* and 109*b* are implemented in an embodiment of the invention from each of strap buckles 104*c* and 104*d* to slip anchors 105*c* and 105*d* joined one each to torso webs 113 and 114 as shown.

Referring firstly to unique strap 109*a*, strap 109*a* is a single length of strap material that passes through both slip anchor 105*c* and a lower loop of strap buckle 104*c*, without being joined to either. One end of strap 109*a* proceeds downward from strap buckle 104*c* and an opposite end proceeds upward from slip anchor 105*c*, and these ends meet at a median height at an anchor ring 112. Both ends of strap 109*a* are joined to the anchor ring 112 such as by folding over and stitching or by some others way, such as adhesive or stapling. It is again emphasized that in one embodiment strap 109*a* passes through slip anchor 105*c* and strap buckle 104*c* without being joined to either.

Referring now to unique strap 109*b*, strap 109*b* is implemented just as described above for strap 109*a*, except for extending between strap buckle and slip anchor 105*d*, connecting to web 114. One other difference between strap 109*a* and 109*b* is between anchor ring 112 for strap 109*a* and anchor ring 111 for strap 109*b*, which difference will become clear in description below.

Figure 5:
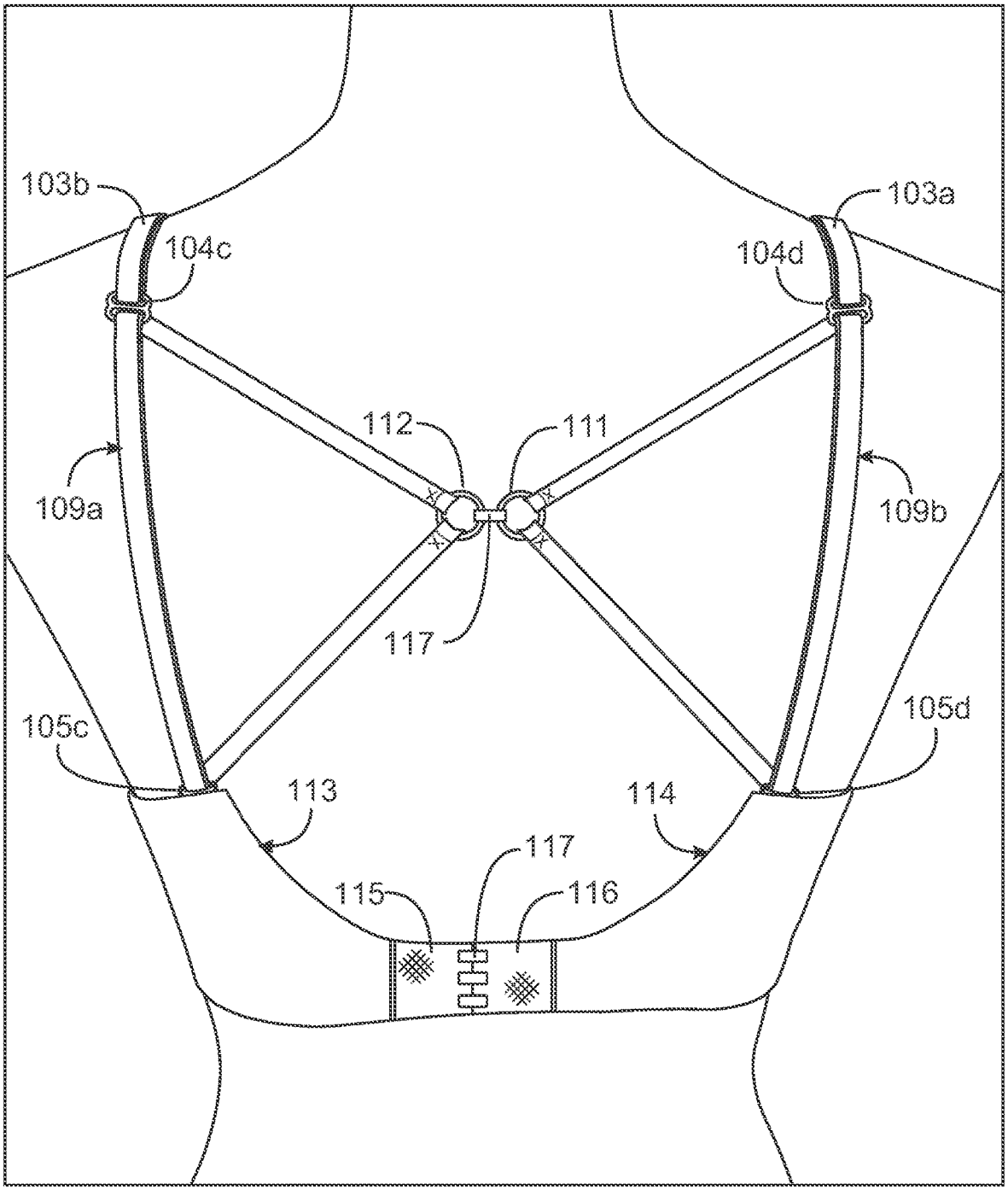
FIG. 5 is a back elevation view of the arrangement of FIG. 4 in an alternative state.

FIG. 5 is a back elevation view of the arrangement of FIG. 4 in an alternative state. In FIG. 5 the wearer has grasped anchor rings 111 and 112 and pulled both to the center of the back, where the wearer has hooked anchor ring 111 to anchor ring 112 by a hook 117 that is permanently joined to one or the other of the anchor rings and is adapted to be hooked over the other. The act of pulling the anchor rings to the center and hooking them together, because the anchor rings are fixed to the ends of the straps 109*a* and 109*b*, stretches both straps 109*a* and 109*b*, and exerts a horizontal force component on both strap buckles 104*c* and 104*d*, as well as enhancing the vertical force component. This state of the strap arrangement prevents straps 103*a* and 103*b* over the wearer's shoulders from slipping out toward the wearer's arms, at the same time maintain a vertical support on web components 113 and 114.

Figure 6A:
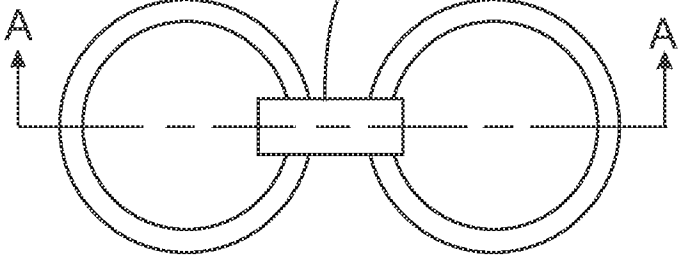
FIG. 6A is a plan view of two anchor loops joined in an embodiment of the invention.
Figure 6B:
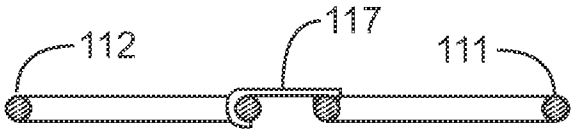
FIG. 6B is a section view of the two anchor loops of FIG. 6A.

FIG. 6A is an enlarged elevation view of anchor rings 112 and 113 with hook 117 to illustrate more clearly how the anchor rings may be joined and disjoined by the wearer of the brassiere. FIG. 6B is a section of the anchor rings and hook of FIG. 6A along section line A-A in FIG. 6A. It may be seen in the section view that hook 117 is welded to anchor ring 111 in this example and has a curved end that hooks over anchor ring 112. Hook 117 might be fixed to either anchor ring and may hook over the other. Other sorts of hook mechanisms my be used as well.

In one embodiment of the invention an aftermarket strap arrangement is provided that may be assembled to an existing brassiere. The aftermarket strap arrangement has first and second adjustable straps 103*a* and 103*b*, with unattached ends, joined to first and second strap buckles 104*c* and 104*d*, along with first and second single straps 109*a* and 109*b* passing through loops of strap buckles 104*c* and 104*d*, and loops of slip anchors 105*c* and 105*d*. Unattached ends of straps 103*a* and 103*b* may be sewn or fixed by adhesive to points of the cups and slip anchors 105*c* and 105*d* may be joined to web straps of an existing brassiere.

Figure 7:
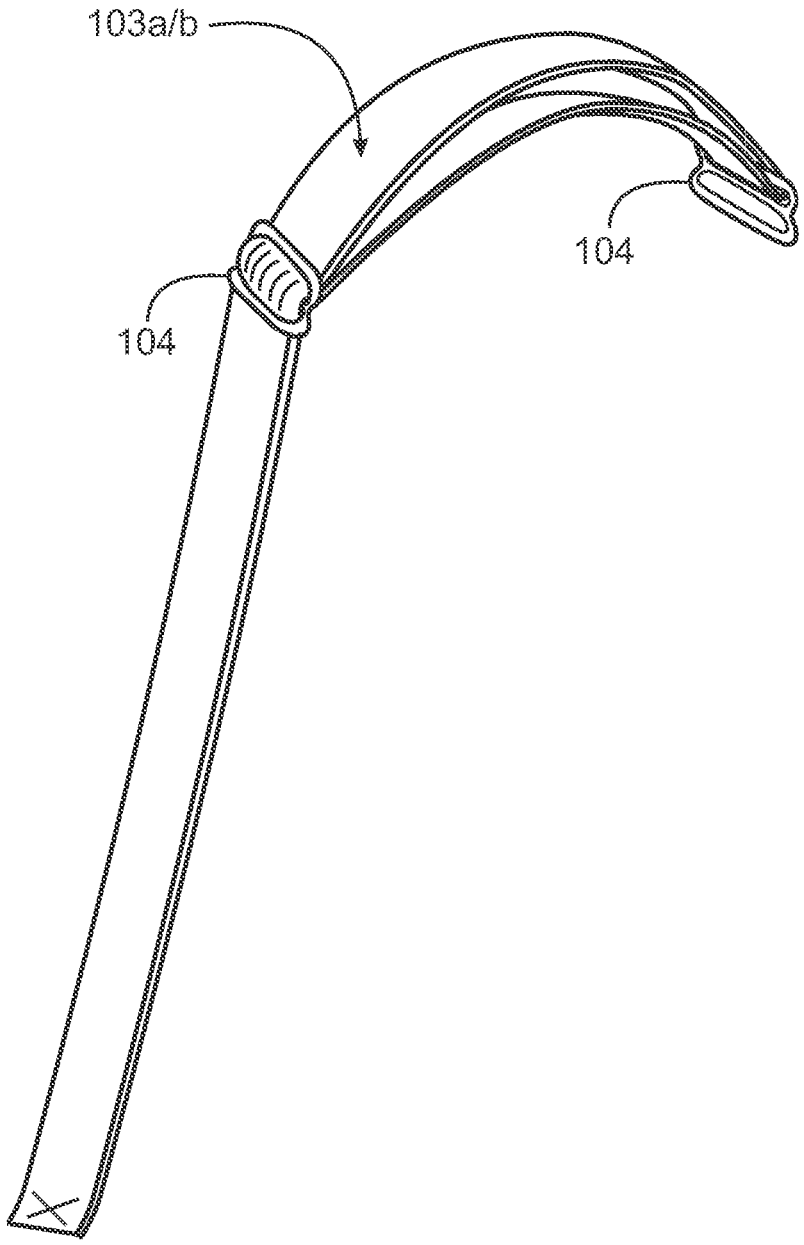
FIG. 7 illustrates a slip anchor fixed to a fabric patch with an adjustable strap passing through a loop of the slip anchor.

FIG. 7 illustrates a strap 103 with an unattached lower end that may be sewn or joined by adhesive to an upper region of a cup of an existing brassiere.

A person of ordinary skill in the art will understand that the embodiments illustrated and described herein are entirely exemplary, and not limiting to the scope of the invention. Many alterations might be made to the examples described while still within the scope of the invention. For example, referring to FIG. 4, illustrating an embodiment of the invention, straps 109*a* and 109*b* are illustrated and described with an outer and an inner length of the strap between strap buckle 104 and slip anchor 105. The anchor rings are illustrated and described as being joined to ends of the straps on the inner length. They could just as well be joined to the ends of the straps in the outer length, still within the scope of the invention. Further, straps 109*a* and 109*b* might in an alternative embodiment be firmly attached to anchor 105 while still sliding through strap buckle 104. This alternative would still function as the invention is intended to function.

There are similarly many other alterations that might be made within the scope of the invention. The invention is limited only by the scope of the claims.

The invention claimed is:

1. A brassiere, comprising:

a first cup and a second cup attached to carry breasts of a wearer of the brassiere;

a first torso web extending from the first cup, adapted to form around the wearer's torso, having a first joining mechanism at an end away from the first cup;

a second torso web extending from the second cup, adapted to form around the wearer's torso, having a second joining mechanism at an end away from the second cup, such that the first and second torso webs, joined by the joining mechanisms, secure the brassiere around the wearer's torso;

a first adjustable strap attached at an upper extremity of the first cup, having a first adjusting buckle in front and having a first strap buckle at an end away from the attachment to the first cup, the first strap buckle adapted to present over the wearer's first shoulder;

a second adjustable strap attached at an upper extremity of the second cup, having a second adjusting buckle in front and having a second strap buckle at an end away from the attachment to the second cup, the second strap buckle adapted to present over the wearer's second shoulder;

a first single strap having a first and a second end, the first single strap passing through a loop of the first strap buckle and through a loop of a first slip anchor fastened to an upper edge of the first torso web, forming an outer substantially vertical first elastic connection between the first strap buckle and the first slip anchor, the first and second ends of the first single strap fastened to a single first anchor loop at a midpoint between the first strap buckle and the first slip anchor, forming an inner, substantially vertical second elastic connection behind the first substantially vertical elastic connection; and a second single strap having a first and a second end, the second single strap passing through a loop of the second strap buckle and through a loop of a second slip anchor fastened to an upper edge of the second torso web, forming an outer substantially vertical third elastic connection between the second strap buckle and the second slip anchor, the first and second ends of the second single strap fastened to a single second anchor loop at a midpoint between the second strap buckle and the second slip anchor, and forming an inner, substantially vertical fourth elastic connection behind the third substantially vertical elastic connection.

2. The brassiere of claim 1 further comprising the first and second anchor loops moved to be adjacent and joined at a midpoint horizontally between the between the first and the third substantially vertical elastic connections, such that a horizontal force component is applied toward center to both the two strap buckles and the two slip anchors, while the first and third elastic connections continue to provide substantially vertical force components between the strap buckles and the slip anchors.

3. The brassiere of claim 2 wherein the first anchor loop has a hook element securely joined, the hook element having a curved end adapted to hook over a portion of the second anchor loop.

4. A bra strap ensemble, comprising:

a first adjustable strap having an unattached single end and a first adjusting buckle, with the first adjustable strap passing through a loop of a first strap buckle at an end away from the unattached single end;

a second adjustable strap having an unattached single end and a second adjusting buckle, with the second adjustable strap passing through a loop of a second strap buckle at an end away from the unattached single end;

a first single strap having a first and a second end, the first single strap passing through a loop of the first strap buckle and through a loop of a first slip anchor, forming a first elastic connection between the first strap buckle and the third slip anchor, the first and second ends of the first single strap fastened to a single first anchor loop at a midpoint between the first strap buckle and the first slip anchor, forming an inner, substantially vertical second elastic connection behind the first substantially vertical elastic connection; and a second single strap having a first and a second end, the second single strap passing through a loop of the second strap buckle and through a loop of a second slip anchor, forming a second elastic connection between the second strap buckle and the second slip anchor, the first and second ends of the first single strap fastened to a single first anchor loop at a midpoint between the first strap buckle and the first slip anchor, forming an inner, substantially vertical second elastic connection behind the first substantially vertical elastic connection;

wherein the bra strap ensemble is adapted to be fastened to web straps of an existing brassiere by the unattached single ends of the first and the second adjustable straps.

5. The aftermarket bra strap ensemble of claim 4 wherein the first anchor loop has a hook element securely joined, the hook element having a curved end adapted to hook over a portion of the second anchor loop.

* * * * *